United States Patent [19]

Bland et al.

[11] Patent Number: 4,659,315

[45] Date of Patent: Apr. 21, 1987

[54] HYDRAULIC SYSTEM FOR MARINE PROPULSION DEVICES

[75] Inventors: Gerald F. Bland, Glenview; Stephen R. Johnson, Waukegan; Donald K. Sullivan, Arlington Heights, all of Ill.

[73] Assignee: Outboard Marine Corporation, Waukegan, Ill.

[21] Appl. No.: 731,160

[22] Filed: May 6, 1985

[51] Int. Cl.[4] ..... B63H 5/12

[52] U.S. Cl. ..... 440/61; 440/57; 440/53

[58] Field of Search ..... 440/61, 57, 52, 53, 440/55; 138/110; 91/420; 92/8

[56] References Cited

U.S. PATENT DOCUMENTS

| | | | |
|---|---|---|---|
| 2,755,766 | 7/1956 | Wanzer | 440/57 |
| 3,186,375 | 6/1965 | Cass | 440/55 |
| 3,577,953 | 5/1971 | Braun et al. | 440/55 |
| 3,893,407 | 7/1975 | Hurst | 440/57 |
| 3,915,111 | 10/1975 | Buddrus | 440/5 |
| 3,999,502 | 12/1976 | Mayer | 440/52 |
| 4,052,952 | 10/1977 | Hale et al. | 440/62 |
| 4,216,737 | 8/1980 | Niederste-Hollenberg et al. | 440/61 |
| 4,325,700 | 4/1982 | Kern et al. | 440/61 |
| 4,345,624 | 8/1982 | Rider | 138/110 |
| 4,384,856 | 5/1983 | Hall et al. . | |
| 4,449,945 | 5/1984 | Ferguson | 440/53 |

FOREIGN PATENT DOCUMENTS

| | | |
|---|---|---|
| 1002715 | 8/1965 | United Kingdom . |
| 1532323 | 11/1978 | United Kingdom . |

*Primary Examiner*—Joseph F. Peters, Jr.
*Assistant Examiner*—Paul E. Salmon
*Attorney, Agent, or Firm*—Michael, Best & Friedrich

[57] ABSTRACT

A marine propulsion device comprising a gimbal housing adapted to be fixedly attached to the transom of a boat and including an end plate adapted to be generally aligned with the boat transom and having an opening, opposite sides, and a rear surface, the gimbal housing also including a first generally vertical side member extending rearwardly from one side of the end plate, and a second generally vertical side member extending rearwardly from the other side of the end plate, a gimbal ring pivotally connected to the gimbal housing for pivotal movement relative to the gimbal housing about a generally vertical steering axis, a propulsion unit pivotally connected to the gimbal ring for pivotal movement relative to the gimbal ring about a generally horizontal tilt axis, and for pivotal movement with the gimbal ring about the steering axis, a hydraulic cylinder/piston assembly connected between the gimbal ring and the propulsion unit for effecting pivotal movement of the propulsion unit relative to the gimbal ring, and a conduit having one end adapted to communicate with a source of hydraulic fluid inside the boat, and an opposite end communicating with the hydraulic cylinder/piston assembly, the conduit extending through the opening in the end plate, downwardly from the opening in the end plate and inwardly of the side members of the gimbal housing along the rear surface of the end plate, and rearwardly to the hydraulic cylinder/piston assembly.

17 Claims, 8 Drawing Figures

HYDRAULIC SYSTEM FOR MARINE PROPULSION DEVICES

RELATED APPLICATION

Attention is directed to U.S. Sullivan patent application Ser. No. 731,159, filed concurrently herewith and assigned to the assignee of this application.

BACKGROUND OF THE INVENTION

The invention relates to hydraulic systems for marine propulsion devices, and, more particularly, to means for supplying hydraulic fluid from a source of fluid inside a boat to hydraulic cylinder/piston assemblies located externally of the boat.

In marine propulsion devices, it is common to have hydraulic cylinder/piston assemblies located externally of the boat for effecting pivotal movement of the propulsion unit relative to its mounting bracket. For example, in marine propulsion devices of the stern drive or inboard/outboard type, it is common to have hydraulic cylinder/piston assemblies connected between the gimbal ring and the propulsion unit for effecting tilting movement of the propulsion unit relative to the gimbal ring. In other types of marine propulsion devices, such as outboard motors, it is known to have hydraulic cylinder/piston assemblies connected between the mounting bracket and the propulsion unit for effecting steering and/or tilting movement of the propulsion unit relative to the mounting bracket.

In many of these marine propulsion devices having hydraulic assemblies located externally of the boat, means are provided for supplying hydraulic fluid to the hydraulic assemblies from a source of fluid inside the boat. Such means typically include hydraulic lines extending from inside the boat to the hydraulic assemblies. This presents several problems.

On problem is whether to run the hydraulic lines over the transom or through the transom and, if through the transom, how to seal the opening through which the hydraulic lines pass.

Another problem, present in marine propulsion devices having two cooperating hydraulic assemblies, is how to supply hydraulic fluid simultaneously to the two assemblies.

Another problem is how to protect the portions of the hydraulic lines extending externally of the transom.

One means for supplying hydraulic fluid simultaneously to a pair of hydraulic assemblies is disclosed in U.S. Hale Pat. No. 4,052,952, issued Oct. 11, 1977. Hale discloses a hydraulic manifold positioned between a pair of tilt/trim cylinders for supplying hydraulic fluid simultaneously to the cylinders. The manifold pivots with the cylinders relative to the mounting bracket and is not fixed to the transom or to the mounting bracket.

Various means have been devised for routing hydraulic lines over or through a boat transom. Some of these means are disclosed in the patents cited below.

Attention is directed to the following U.S. patents which disclose hydraulic systems for marine propulsion devices:

| | | |
|---|---|---|
| Kern | 4,325,700 | May 20, 1982 |
| Mayer | 3,999,502 | December 28, 1976 |
| Ferguson | 4,449,945 | May 22, 1984 |
| Braun | 3,577,953 | May 11, 1971 |
| Buddrus | 3,915,111 | October 28, 1975 |

Attention is also directed to U.S. Beavers Pat. No. 3,570,534, issued Mar. 16, 1971, which discloses a hydraulic manifold.

SUMMARY OF THE INVENTION

The invention provides a marine propulsion device comprising a gimbal housing adapted to be fixedly attached to the transom of a boat and including an end plate adapted to be generally aligned with the boat transom and having an opening, opposite sides, and a rear surface, the gimbal housing also including a first generally vertical side member extending rearwardly from one of the sides of the end plate, and a second generally vertical side member extending rearwardly from the other of the sides of the end plate, a gimbal ring pivotally connected to the gimbal housing for pivotal movement relative to the gimbal housing about a generally vertical steering axis, a propulsion unit pivotally connected to the gimbal ring for pivotal movement relative to the gimbal ring about a generally horizontal tilt axis, and for pivotal movement with the gimbal ring about the steering axis, a hydraulic cylinder/piston assembly connected between the gimbal ring and the propulsion unit for effecting pivotal movement of the propulsion unit relative to the gimbal ring, and conduit means having one end adapted to communicate with a source of hydraulic fluid inside the boat, and an opposite end communicating with the hydraulic cylinder/piston assembly, the conduit means extending through the opening in the end plate, downwardly from the opening in the end plate and inwardly of the side members of the gimbal housing along the rear surface of the end plate, and rearwardly to the hydraulic cylinder/piston assembly.

In one embodiment, the conduit means includes a manifold fixedly attached to the rear surface of the end plate adjacent the opening in the end plate, a first pair of hydraulic lines extending through the opening in the end plate and having one end adapted to communicate with the source of fluid, and an opposite end communicating with the manifold, and a second pair of hydraulic lines communicating between the manifold and the cylinder/piston assembly and extending downwardly from the manifold and inwardly of the sides of the gimbal housing along the rear surface of the end plate, and rearwardly to the cylinder/piston assembly.

In one embodiment, each of the hydraulic lines of the second pair includes a portion, and a protective jacket covering the portion.

In one embodiment, each of the hydraulic lines of the second pair includes a rigid portion communicating with the manifold, and a flexible portion communicating between the rigid portion and the cylinder/piston assembly.

In one embodiment, each of the hydraulic lines of the second pair includes a protective jacket convering the flexible portion.

In one embodiment, the hydraulic cylinder/piston assembly includes a cylinder having a forward end, a rearward end, and an upper portion, and a cover member over the upper portion of the cylinder, and the second pair of hydraulic lines communicates with the cylinder, one of the hydraulic lines of the second pair being connected to the forward end of the cylinder, and the other of the hydraulic lines of the second pair extending along the cylinder inside the cover member and being connected to the rearward end of the cylinder.

The invention also provides a marine propulsion device comprising a gimbal housing adapted to be fixedly attached to the transom of a boat and including an end plate adapted to be generally aligned with the boat transom and having an upper end, an opening adjacent the upper end, opposite sides, and a rear surface, the gimbal housing also including a first generally vertical side member extending rearwardly from one side of the end plate, and a second generally vertical side member extending rearwardly from the other side of the end plate, a gimbal ring pivotally connected to the gimbal housing for pivotal movement relative to the gimbal housing about a generally vertical steering axis, the gimbal ring having a lower end with opposite sides, a propulsion unit pivotally connected to the gimbal ring for pivotal movement relative to the gimbal ring about a generally horizontal tilt axis, and for pivotal movement with the gimbal ring about the steering axis, a first hydraulic cylinder/piston assembly connected between one of the sides of the lower end of the gimbal ring and the propulsion unit for effecting pivotal movement of the propulsion unit relative to the gimbal ring, the first assembly including a first cylinder having a forward end, a rearward end, and an upper portion, and a first cover member over the upper portion of the first cylinder, a second hydraulic cylinder/piston assembly connected between the other of the sides of the lower end of the gimbal ring and the propulsion unit for effecting pivotal movement of the propulsion unit relative to the gimbal ring, the second assembly including a second cylinder having a forward end, a rearward end, and an upper portion, and a second cover member over the upper portion of the second cylinder, and conduit means extending through the opening in the end plate and having one end adapted to communicate with a source of hydraulic fluid inside the boat, and an opposite end communicating with the first and second cylinders, the conduit means including a first pair of hydraulic lines communicating with the first cylinder and extending downwardly from adjacent the opening in the end plate and inwardly of the first side of the gimbal housing along the rear surface of the end plate, and rearwardly to the forward end of the first cylinder, one of the hydraulic lines of the first pair being connected to the forward end of the first cylinder, and the other of the hydraulic lines of the first pair extending along the first cylinder inside the first cover member and being connected to the rearward end of the first cylinder, and a second pair of hydraulic lines communicating with the second cylinder and extending downwardly from adjacent the opening in the end plate and inwardly of the second side of the gimbal housing along the rear surface of the end plate, and rearwardly to the forward end of the second cylinder, one of the hydraulic lines of the second pair being connected to the forward end of the second cylinder, and the other of the hydraulic lines of the second pair extending along the second cylinder inside the second cover member and being connected to the rearward end of the second cylinder.

The invention also provides a marine propulsion device comprising a gimbal housing adapted to be fixedly attached to the transom of a boat, a gimbal ring pivotally connected to the gimbal housing for pivotal movement relative to the gimbal housing about a generally vertical steering axis, a propulsion unit pivotally connected to the gimbal ring for pivotal movement relative to the gimbal ring about a generally horizontal tilt axis, and for pivotal movement with the gimbal ring about the steering axis, a hydraulic cylinder/piston assembly connected between the gimbal ring and the propulsion unit for effecting pivotal movement of the propulsion unit relative to the gimbal ring, the assembly including a cylinder having a forward end, a rearward end, and an upper portion, and a cover member over the upper portion of the cylinder, and a pair of hydraulic lines communicating with the cylinder, one of the hydraulic lines being connected to the forward end of the cylinder, and the other of the hydraulic lines extending along the cylinder inside the cover member and being connected to the rearward end of the cylinder.

The invention also provides a marine propulsion device comprising a gimbal housing adapted to be fixedly attached to the transom of a boat and including an end plate adapted to be generally aligned with the boat transom and having an upper end, an opening adjacent the upper end, opposite sides, and a rear surface, the gimbal housing also including a first generally vertical side member extending rearwardly from one side of the end plate, and a second generally vertical side member extending rearwardly from the other side of the end plate, a gimbal ring pivotally connected to the gimbal housing for pivotal movement relative to the gimbal housing about a generally vertical steering axis, the gimbal ring having a lower end and opposite sides, a propulsion unit pivotally connected to the gimbal ring for pivotal movement relative to the gimbal ring about a generally horizontal tilt axis, and for pivotal movement with the gimbal ring about the steering axis, a first hydraulic cylinder/piston assembly connected between one side of the lower end of the gimbal ring and the propulsion unit for effecting pivotal movement of the propulsion unit relative to thed gimbal ring, the first assembly including a first cylinder having an upper portion, a forward end connected to the gimbal ring, and a rearward end, a first piston slidably received in the first cylinder and dividing the first cylinder into forward and rearward pressure chambers, a first piston rod having an inner end fixedly attached to the first piston, and an outer end extending outwardly of the rearward end of the first cylinder and being connected to the propulsion unit, and a first cover member over the upper portion of the first cylinder, a second hydraulic cylinder/piston assembly connected between the other side of the lower end of the gimbal ring and the propulsion unit for effecting pivotal movement of the propulsion unit relative to the gimbal ring, the second assembly including a second cylinder having an upper portion, a forward end connected to the gimbal ring, and a rearward end, a second piston slidably received in the second cylinder and dividing the second cylinder into forward and rearward pressure chambers, a second piston rod having an inner end fixedly attached to the second piston, and an outer end extending outwardly of the rearward end of the second piston and being connected to the propulsion unit, and a second cover member over the upper portion of the second cylinder, a manifold fixedly attached to the rear surface of the end plate adjacent the opening in the end plate, conduit means extending through the opening in the end plate and having one end adapted to communicate with a source of hydraulic fluid inside the boat, and an opposite end communicating with the manifold, a first pair of hydraulic lines communicating between the first cylinder and the manifold and extending downwardly from the manifold and inwardly of the first side of the gimbal housing along the rear surface of the end plate, and rearwardly to the forward end of the first cylinder, one of the hydraulic lines of the first pair being connected to the forward pressure chamber of the first cylinder, and the other of the hydraulic lines of the first pair extending along the first cylinder inside the first cover member and being connected to the rearward pressure chamber of the first cylinder, each of the hydraulic lines of the first pair including a first rigid portion communicating with the manifold, a first flexible portion communicating between the first rigid portion and the first cylinder, and a protective jacket covering the first flexible portion, and a second pair of hydraulic lines communicating between the second cylinder and the manifold and extending downwardly from the manifold and inwardly of the second side of the gimbal housing along the rear surface of the end plate, and rearwardly to the forward end of the second cylinder, one of the hydraulic lines of the second pair being connected to the forward pressure chamber of the second cylinder, and the other of the hydraulic lines of the second pair extending along the second cylinder inside the second cover member and being connected to the rearward pressure chamber of the second cylinder, each of the hydraulic lines of the second pair including a second rigid portion communicating with the manifold, a second flexible portion communicating between the second rigid portion and the second cylinder, and a protective jacket covering the second flexible portion.

A principal feature of the invention is the provision of a marine propulsion device comprising a gimbal housing including an end plate adapted to be generally aligned with the boat transom and having an upper end, an opening adjacent the upper end, opposite sides, and a rear surface, the gimbal housing also including a first generally vertical side member extending rearwardly from one side of the end plate, and a second generally vertical side member extending rearwardly from the other side of the end plate. The marine propulsion device also comprises a pair of hydraulic cylinder/piston assemblies connected between the gimbal ring and the propulsion unit for effecting pivotal movement of the propulsion unit relative to the gimbal ring, and conduit means extending through the opening in the end plate and communicating between a source of hydraulic fluid inside the boat and the hydraulic cylinder/piston assemblies. The conduit means includes hydraulic lines extending downwardly from the opening in the end plate and inwardly of the sides of the gimbal housing along the rear surface of the end plate, and rearwardly to the forward ends of the respective cylinders. Preferably, the portions of the hydraulic lines extending between the gimbal housing and the cylinders are covered by protective jackets. This routing of the lines and the protective jackets solve the problem of how to protect the portions of the hydraulic lines extending externally of the transom.

Another principal feature of the invention is the provision of cover members surrounding the cylinders, with the hydraulic lines connected to the rearward ends of the cylinders extending along the cylinders inside the cover members. This further protects the hydraulic lines and gives the cylinders a streamlined appearance.

Other features and advantages of the invention will become apparent to those skilled in the art upon review of the following detailed description, claims, and drawings.

Figure 1:
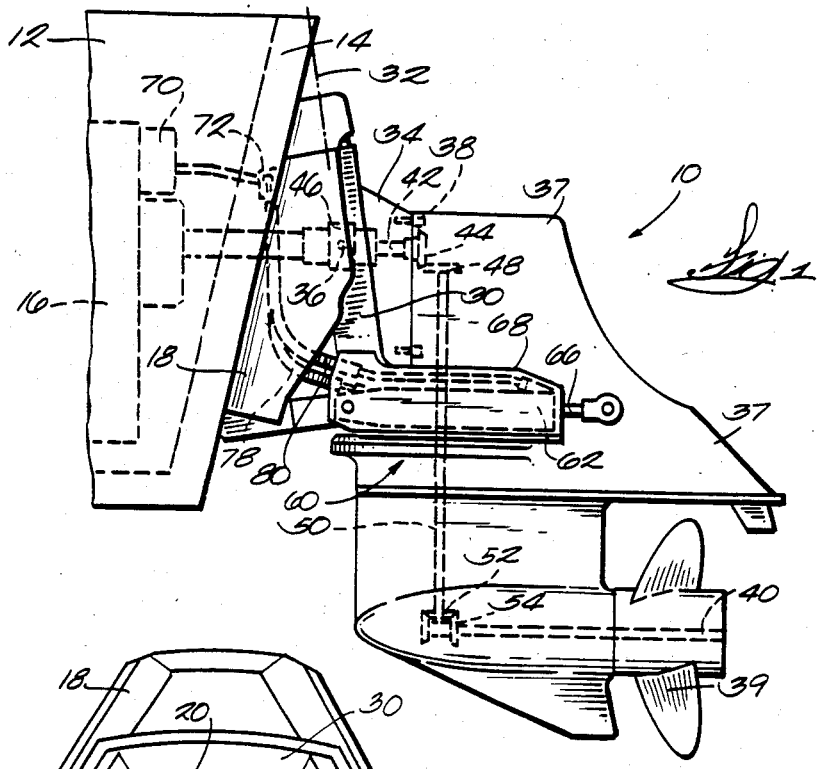
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpuse of description and should not be regarded as limiting.

DESCRIPTION OF THE PREFERRED EMBODIMENT

Illustrated in the drawings is a marine propulsion device 10 mounted on a boat 12 having a transom 14. In the preferred embodiment, the marine propulsion device 10 is of the stern drive or inboard/outboard type.

As best shown in FIG. 1, the marine propulsion device 10 comprises an engine 16 securely mounted on the boat frame by suitable means such as rubber mounts (not shown). The marine propulsion device 10 also comprises a mounting bracket or gimbal housing 18 mounted on the outer surface of the boat transom 14 and fixedly attached to the boat transom 14. The gimbal housing 10 can be attached to the boat transom 14 by any suitable means, such as by bolts extending through the transom 14.

Figure 5:
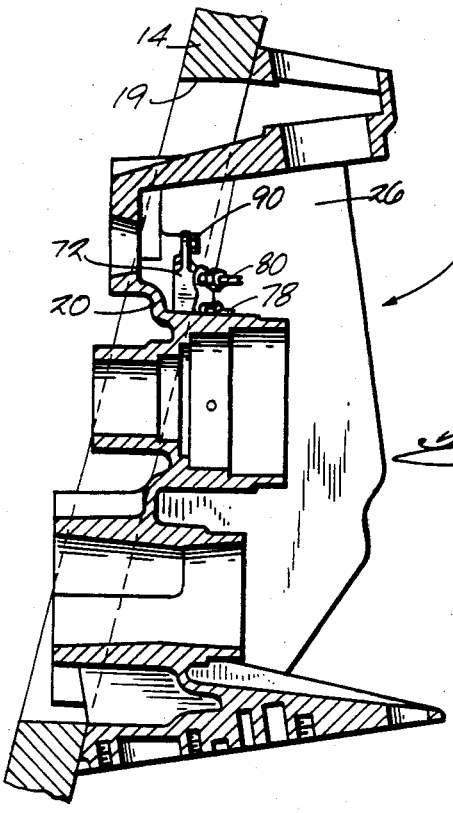
FIG. 5 is a vertical cross-sectional view of the gimbal housing.

In the preferred embodiment, as best shown in FIG. 5, the gimbal housing 18 is sealed to the transom 14 and includes a forward portion extending through an opening 19 in the transom 14. This portion of the gimbal housing 18 includes an end plate 20 generally aligned with the transom and having an upper end, an opening 22 adjacent the upper end, opposite sides, and a rear surface. In the illustrated construction, the end plate 20 is generally vertical. The gimbal housing 18 also includes a first or left (as viewed in FIG. 2) generally vertical side member 24 extending rearwardly from the left side of the end plate 20, and a second or right generally vertical side member 26 extending rearwardly from the right side of the end plate 20.

The marine propulsion device 10 also comprises a gimbal ring 30 connected to the gimbal housing 18 for pivotal movement relative to the gimbal housing 18 about a generally vertical steering axis 32, and a pivot housing 34 connected to the gimbal ring 30 for pivotal movement relative to the gimbal ring 30 about a generally horizontal tilt axis 36. Such a construction is well known in the art and will not be described in detail other than as necessary for an understanding of the invention. In the illustrated construction, the gimbal ring 30 includes spaced apart generally vertical side members, and a lower end, and the gimbal ring 30 is partially covered by the side members 24 and 26 of the gimbal housing 18.

The marine propulsion device 10 also comprises a propulsion unit 37 removably connected to the pivot housing 34 for common pivotal movement of the propulsion unit 37 with the pivot housing 34. In the illustrated construction, the propulsion unit 37 is removably connected to the pivot housing 34 by a plurality of bolts 38. The propulsion unit 37 includes a propeller 39 mounted on a propeller shaft 40, and a generally horizontal drive shaft 42 having one end removably connected to the engine 16 and an opposite end having thereon a bevel gear 44. A universal joint 46 attached to the horizontal drive shaft 42 allows pivotal movement of the drive shaft 42 with the propulsion unit 37. The bevel gear 44 drives a bevel gear 48 on the upper end of a vertical drive shaft 50. The lower end of the vertical drive shaft 50 has thereon a driving gear 52. A reversible transmission selectively clutches a pair of driven gears 54 to the propeller shaft 40 to transmit forward or reverse motion to the propeller shaft 40 from the driving gear 52.

Figure 2:
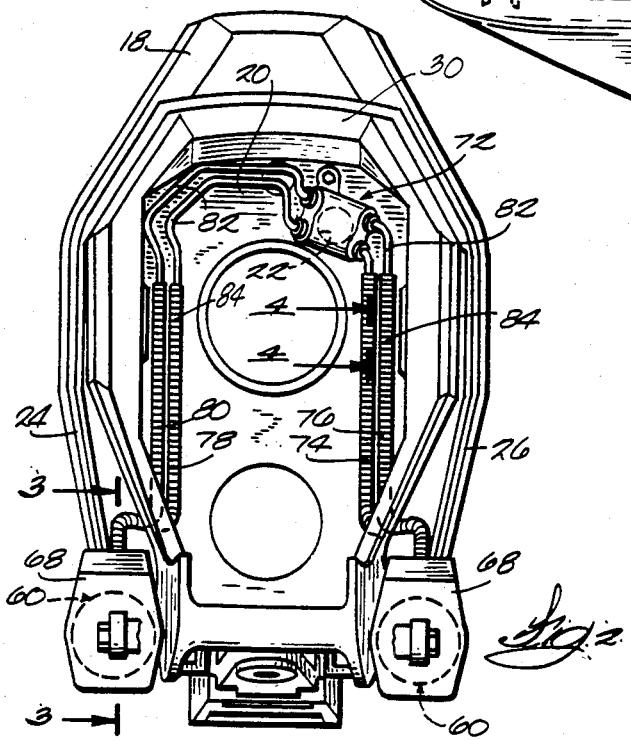
FIG. 2 is an end view of the marine propulsion device with the pivot housing and propulsion unit removed.

The marine propulsion device 10 also comprises a pair of hydraulic cylinder/piston assemblies 60 pivotally connected between the gimbal housing 18 and the propulsion unit 37 for effecting pivotal movement (tilt and trim movement) of the propulsion unit 37 relative to the gimbal housing 18 and relative to the gimbal ring 30 about the tilt axis 36. In the preferred embodiment, the hydraulic cylinder/piston assemblies 60 are connected between the lower end of the gimbal ring 30 and the propulsion unit 37. The cylinder/piston assemblies 60 extend on opposite sides of the propulsion unit 37. Only one cylinder/piston assembly 60 is shown in FIG. 1. Both are shown in FIG. 2.

Preferably, each of the cylinder/piston assemblies 60 includes a cylinder 62 having an upper portion, a forward end pivotally connected to the gimbal ring 30, and a rearward end. The cylinder/piston assemblies 60 each also include a piston 64 slidably received in the cylinder 62 for reciprical movement therein, the piston 64 dividing the cylinder 62 into forward and rearward pressure chambers. The cylinder/piston assemblies 60 also include a piston rod 66 having a forward or inner end fixedly attached to the piston 64 and extending outwardly of the rearward end of the cylinder 62, and a rearward or outer end pivotally attached to the propulsion unit 37. Increasing the pressure in the forward pressure chamber of the cylinder 62 causes the piston rod 66 to extend, thereby causing the propulsion unit 37 to tilt upwardly, and increasing the pressure in the rearward pressure chamber of the cylinder 62 causes the piston rod 66 to retract, thereby causing the propulsion unit 37 to tilt downwardly.

Each of the hydraulic cylinder/piston assemblies 60 also includes a cover member 68 over the upper portion of the cylinder 62. The reason for the cover member 68 is explained hereinafter.

The marine propulsion device 10 further comprises conduit means having one end communicating with a source of hydraulic fluid 70 inside the boat 12, and an opposite end communicating with the hydraulic cylinder/piston assemblies 60. The conduit means extends through the opening 22 in the end plate 20 in the gimbal housing 18, downwardly from the opening 22 in the end plate 20 and inwardly of the side members 24 and 26 of the gimbal housing 18 along the rear surface of the end plate 20, and rearwardly to the hydraulic cylinder/piston assemblies 60. Because of this routing of the conduit means, the portion of the conduit means extending externally of the boat 12 is exposed only between the gimbal housing 18 and the cylinders 60. The remainder of the conduit means is covered by the side members 24 and 26 of the gimbal housing 18.

In the preferred embodiment, the conduit means includes a manifold 72 fixedly attached to the rear surface of the end plate 20 adjacent the opening 22 in the end plate 20 (either in the opening 22 or slightly spaced from the opening 22), first fluid line means communicating between the manifold 72 and the hydraulic cylinder/piston assemblies 60 for supplying hydraulic fluid to the cylinder/piston assemblies 60, and second fluid line means extending through the opening 22 in the gimbal housing 18 and having one end communicating with the source of fluid 70, and an opposite end communicating with the manifold 72.

While various suitable fluid line means can be employed, in the preferred embodiment, the first fluid line means includes a first or right pair of hydraulic lines 74 and 76 communicating between the manifold 72 and the first or right cylinder 62, the hydraulic line 74 of the right pair being connected to the forward end and the forward pressure chamber of the right cylinder 62, and the hydraulic line 76 of the right pair being connected to the rearward end and the rearward pressure chamber of the right cylinder 62. The first fluid line means also includes a second or left pair of hydraulic lines 78 and 80 communicating between the manifold 72 and the second or left cylinder 62, the hydraulic line 78 of the left pair being connected to the forward end and the forward pressure chamber of the left cylinder 62, and the hydraulic line 80 of the left pair being connected to the rearward end and the rearward pressure chamber of the left cylinder 62.

Each of the hydraulic lines 74 and 76 of the right pair extends downwardly from the manifold 72 and inwardly of the right side 26 of the gimbal housing 18 along the rear surface of the end plate 20, and rearwardly to the forward end of the right cylinder 62. The hydraulic line 74 is connected to the forward end of the right cylinder 62 in communication with the forward pressure chamber of the right cylinder 62. The hydraulic line 76 includes a rigid portion (not shown) extending along the right cylinder 62 inside the cover member 68 and connected to the rearward end of the right cylinder 62 in communication with the rearward pressure chamber. Each of the hydraulic lines 78 and 80 of the left pair extends downwardly from the manifold 72 and inwardly of the left side 24 of the gimbal housing 18 along the rear surface of the end plate 20, and rearwardly to the forward end of the left cylinder 62. The hydraulic line 78 is connected to the forward end of the left cylinder 62 in communication with the forward pressure chamber, and the hydraulic line 80 includes a rigid portion 81 extending along the left cylinder 62 inside the cover member 68 and connected to the rearward end of the left cylinder 62 in communication with the rearward pressure chamber.

Figure 4:
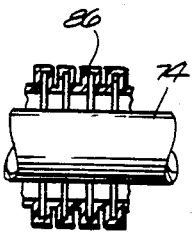
FIG. 4 is a cross-sectional veiw taken along line 4—4 in FIG. 2.
Figure 3:
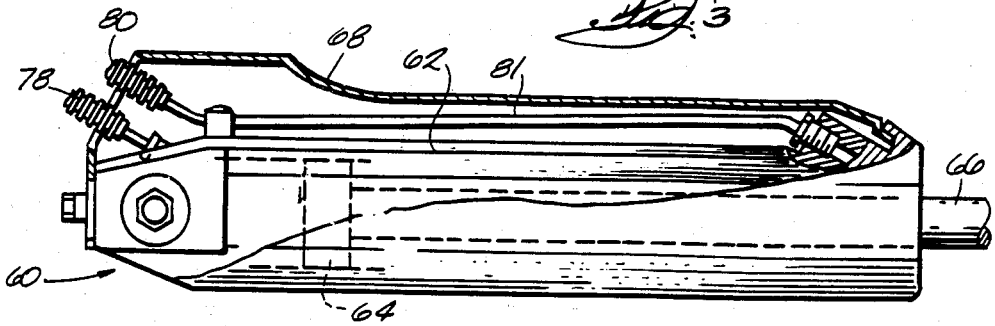
FIG. 3 is a cross-sectional view taken along line 3—3 in FIG. 2.

In the preferred embodiment, each of the hydraulic lines 74, 76, 78 and 80 communicating between the manifold 72 and the cylinders 62 includes a rigid portion 82 communicating with the manifold 72, and a flexible portion 84 communicating between the rigid portion 82 and the respective cylinder 62. The rigid portions 82 of the hydraulic lines are best illustrated in FIG. 2. The rigid portions 82 run along the end plate 20 so that they do not interfere with the gimbal ring 30. The flexible portions 84 run down along the end plate 20 and then rearwardly outside of the gimbal ring 30. Preferably, each of the flexible portions 84 of the hydraulic lines is covered by a protective jacket 86. The protective jacket 86 extends from inside the gimbal housing 18 to inside the cover member 68 of the respective cylinder 62. A protective jacket 86 is shown in cross-section in FIG. 4.

The cover members 68 serve two purposes. First, they protect the hydraulic lines extending along the cylinders 62 to the rearward ends of the cylinders 62. Second, they hide the hydraulic lines and give the cylinders 62 a streamlined appearance.

Figure 6:
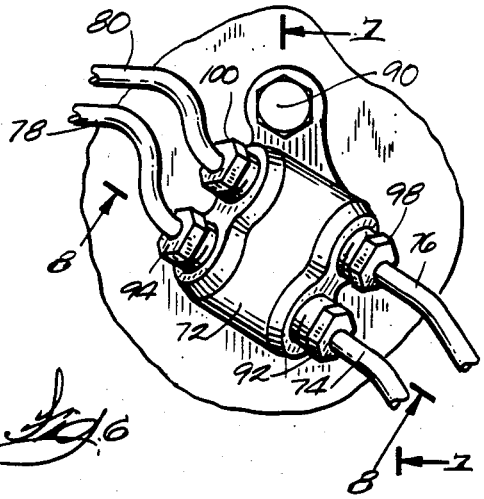
FIG. 6 is an enlarged end view of the manifold.
Figure 7:
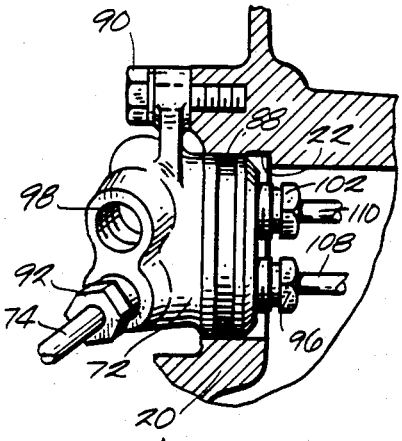
FIG. 7 is a cross-sectional view taken along line 7—7 in FIG. 6.

In the preferred embodiment, the manifold 72 is mounted in the opening 22 in the gimbal housing 18, and the marine propulsion device 10 further comprises means for sealing the opening 22 around the manifold 72 so as to substantially prevent water from passing through the opening 22. In the illustrated construction, as best shown in FIG. 7, the sealing means includes an O-ring 88. As best shown in FIGS. 6 and 7, the manifold 72 is preferably secured to the end plate 20 of the gimbal housing 18 by one or more bolts 90 threadably received in the gimbal housing 18.

Preferably, the manifold 72 includes a first or right front port 92 and a second or left front port 94 both communicating with a first or lower supply/return port 96, and a first or right rear port 98 and a second or left rear port 100 both communicating with a second or upper supply/return port 102. The supply/return ports 96 and 102 communicate with the source of fluid 70, as explained hereinafter. The hydraulic line 74 of the right pair communicates with the right front port 92, and the hydraulic line 76 of the right pair communicates with the right rear port 98. The hydraulic line 78 of the left pair communicates with the left front port 94 and the hydraulic line 80 of the left pair communicates with the left rear port 100.

Figure 8:
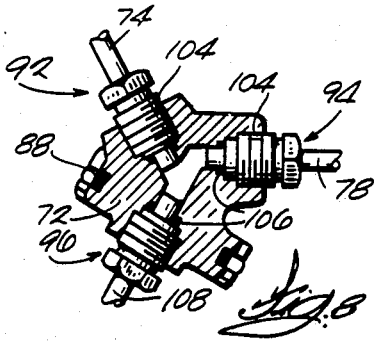
FIG. 8 is a cross-sectional view taken along line 8—8 in FIG. 6.

As best shown in FIG. 8, each of the hydraulic lines 74, 76, 78 and 80 includes an externally threaded end portion, nipple, or fitting 104 which is threaded into the manifold 72 so as to communicate with the respective manifold port. The end portions 104 are sealed to the manifold by O-rings 106.

In the preferred embodiment, the source of fluid 70 (shown schematically in FIG. 1) further includes means for selectively and alternatively supplying hydraulic fluid to the lower supply/return port 96 and to the upper supply/return port 102. Preferably, this supplying means includes a reversible pump (not shown) connected to the supply/return ports 96 and 102 by the second fluid line means communicating between the source of fluid 70 and the manifold 72. In the preferred embodiment, the second fluid line means includes a pair of hydraulic lines 108 and 110, the hydraulic line 108 communicating between the pump and the lower supply/return port 96, the hydraulic line 110 communicating between the pump and the upper supply/return port 102. The pump can be actuated by any suitable operator actuated means.

When the pump is actuated so as to supply hydraulic fluid to the lower supply/return port 96, hydraulic fluid flows out the ports 92 and 94 through lines 74 and 78 to the forward pressure chambers of both of the cylinders 62, so that the piston rods 66 extend and the propulsion unit 37 tilts upwardly. Extension of the piston rods 66 also causes flow of hydraulic fluid out of the rearward pressure chambers of the cylinders 62, through the hydraulic lines 80 and 76 to the manifold 72 through the left and right rear ports 100 and 98, and out of the manifold 72 through the upper supply/return port 102 back to the source of fluid 70. When the pump is actuated to supply hydraulic fluid to the upper supply/return port 102, hydraulic fluid flows out the ports 98 and 100 through lines 76 and 80 to the rearward pressure chambers of the cylinders 62. This causes the piston rods 66 to retract and the propulsion unit 37 to tilt downwardly. The retraction of the piston rods 66 also causes fluid to flow out of the forward pressure chambers of the cylinders 62, through the hydraulic lines 74 and 78 to the manifold 72 through the right and left front ports 92 and 94, and out of the manifold 72 through the lower/supply return port 96 and back to the source of fluid 70.

Various features of the invention are set forth in the following claims.

We claim:

1. A marine propulsion device comprising a gimbal housing adapted to be fixedly attached to the transom of a boat and including an end plate adapted to be generally aligned with the boat transom and having an opening, opposite sides, and a rear surface, said gimbal housing also including a first generally vertical side member extending rearwardly from one of the sides of said end plate, and a second generally vertical side member extending rearwardly from the other of the sides of said end plate, a gimbal ring pivotally connected to said gimbal housing for pivotal movement relative to said gimbal housing about a generally vertical steering axis, a propulsion unit pivotally connected to said gimbal ring for pivotal movement relative to said gimbal ring about a generally horizontal tilt axis located below said opening, and for pivotal movement with said gimbal ring about said steering axis, a hydraulic cylinder/piston assembly pivotally connected to said gimbal ring and to said propulsion unit about respective axes respectively fixed relative to said gimbal ring and said propulsion unit for effecting pivotal movement of said propulsion unit relative to said gimbal ring, and conduit means having one end adapted to communicate with a source of hydraulic fluid inside the boat, and an opposite end communicating with said hydraulic cylinder/piston assembly, said conduit means extending through said opening in said end plate, downwardly from said opening in said end plate and inwardly of said side members of said gimbal housing along said rear surface of said end plate in forward relation to said tilt axis and in rearward relation to the transom, and then rearwardly to said hydraulic cylinder/piston assembly.

2. A marine propulsion device as set forth in claim 1 wherein said conduit means includes a manifold fixedly attached to said rear surface of said end plate adjacent said opening in said end plate, a first pair of hydraulic lines extending through said opening in said end plate and having respective first ends adapted to communicate with the source of fluid, and respective second ends communicating with said manifold, and a second pair of hydraulic lines communicating between said manifold and said cylinder/piston assembly and extending downwardly from said manifold and inwardly of said sides of said gimbal housing along said rear surface of said end plate, and rearwardly to said cylinder/piston assembly.

3. A marine propulsion device as set forth in claim 2 wherein each of said hydraulic lines of said second pair includes a portion, and a protective jacket covering said portion.

4. A marine propulsion device as set forth in claim 2 wherein each of said hydraulic lines of said second pair includes a rigid portion communicating with said manifold and extending downwardly along said rear surface of said end plate, and a flexible portion communicating between said rigid portion and said cylinder/piston assembly.

5. A marine propulsion device as set forth in claim 4 wherein each of said hydraulic lines of said second pair includes a protective jacket covering said flexible portion.

6. A marine propulsion device as set forth in claim 2 wherein said hydraulic cylinder/piston assembly includes a cylinder having a forward end, a rearward end, and an upper portion, and a cover member over said upper portion of said cylinder, and wherein said second pair of hydraulic lines communicates with said cylinder, one of said hydraulic lines of said second pair being connected to said forward end of said cylinder, and the other of said hydraulic lines of said second pair extending along said cylinder inside said cover member and being connected to said rearward end of said cylinder.

7. A marine propulsion device comprising a gimbal housing adapted to be fixedly attached to the transom of a boat and including an end plate adapted to be generally aligned with the boat transom and having an upper end, an opening adjacent said upper end, opposite sides, and a rear surface, said gimbal housing also including a first generally vertical side member extending rearwardly from one side of said end plate, and a second generally vertical side member extending rearwardly from the other side of said end plate, a gimbal ring pivotally connected to said gimbal housing for pivotal movement relative to said gimbal housing about a generally vertical steering axis, said gimbal ring having a lower end with opposite sides, a propulsion unit pivotally connected to said gimbal ring for pivotal movement relative to said gimbal ring about a generally horizontal tilt axis located below said opening, and for pivotal movement with said gimbal ring about said steering axis, a first hydraulic cylinder/piston assembly pivotally connected to one of the sides of said lower end of said gimbal ring and to said propulsion unit about respective axes respectively fixed relative to said gimbal ring and said propulsion unit for effecting pivotal movement of said propulsion unit relative to said gimbal ring, said first assembly including a first cylinder having a forward end, a rearward end, and an upper portion, and a first cover member over said upper portion of said first cylinder, a second hydraulic cylinder/piston assembly connected between the other of the sides of said lower end of said gimbal ring and said propulsion unit for effecting pivotal movement of said propulsion unit relative to said gimbal ring, said second assembly including a second cylinder having a forward end, a rearward end, and an upper portion, and a second cover member over said upper portion of said second cylinder, and conduit means extending through said opening in said end plate and having a first end adapted to communicate with a source of hydraulic fluid inside the boat, and a second end communicating with said first and second cylinders, said conduit means including a first pair of hydraulic lines communicating with said first cylinder and extending downwardly from said opening in said end plate and inwardly of said first side of said gimbal housing along said rear surface of said end plate in forward relation to said tilt axis and in rearward relation to the transom, and then rearwardly to said forward end of said first cylinder, one of said hydraulic lines of said first pair being connected to said forward end of said first cylinder, and the other of said hydraulic lines of said first pair extending along said first cylinder inside said first cover member and being connected to said rearward end of said first cylinder, and a second pair of hydraulic lines communicating with said second cylinder and extending downwardly from said opening in said end plate and inwardly of said second side of said gimbal housing along said rear surface of said end plate in forward relation to said tilt axis and in rearward relation to the transom, and then rearwardly to said forward end of said second cylinder, one of said hydraulic lines of said second pair being connected to said forward end of said second cylinder, and the other of said hydraulic lines of said second pair extending along said second cylinder inside said second cover member and being connected to said rearward end of said second cylinder.

8. A marine propulsion device as set forth in claim 7 wherein each of said hydraulic lines of said first and second pairs includes a portion, and a protective jacket covering said portion.

9. A marine propulsion device as set forth in claim 7 wherein said conduit means further includes a manifold mounted on said end plate adjacent said opening in said end plate, wherein each of said hydraulic lines of said first pair includes a first rigid portion communicating with said manifold and extending downwardly along said rear surface of said end plate, and a flexible portion communicating between said first rigid portion and said first cylinder, and wherein each of said hydraulic lines of said second pair includes a second rigid portion communicating with said manifold and extending downwardly along said rear surface of said end plate, and a flexible portion communicating between said second rigid portion and said second cylinder.

10. A marine propulsion device as set forth in claim 9 wherein said hydraulic lines of said first and second pairs include protective jackets covering said flexible portions.

11. A marine propulsion device comprising a gimbal housing adapted to be fixedly attached to the transom of a boat and having therein an opening, a gimbal ring pivotally connected to said gimbal housing for pivotal movement relative to said gimbal housing about a generally vertical steering axis, a propulsion unit pivotally connected to said gimbal ring for pivotal movement relative to said gimbal ring about a generally horizontal tilt axis located below said opening, and for pivotal movement with said gimbal ring about said steering axis, a hydraulic cylinder/piston assembly pivotally connected to said gimbal ring and to said propulsion unit about respective axes respectively fixed relative to said gimbal ring and said propulsion unit for effecting pivotal movement of said propulsion unit relative to said gimbal ring, said assembly including a cylinder having a foward end, a rearward end, and an upper portion, and a cover member over said upper portion of said cylinder, and a pair of hydraulic lines having respective first portions extending through said opening and downwardly from said opening in forward relation to said tilt axis and in rearward relation to the transom, and respective second portions communicating with said cylinder, said second portion of one of said hydraulic lines being connected to said forward end of said cylinder, and said second portion of the other of said hydraulic lines extending along said cylinder inside said cover member and being connected to said rearward end of said cylinder.

12. A marine propulsion device as set forth in claim 11 wherein each of said second portions of said hydraulic lines includes a sub-portion, and a protective jacket covering said sub-portion.

13. A marine propulsion device as set forth in claim 11 wherein said gimbal housing includes an end plate adapted to be generally aligned with the boat transom, said end plate having therein said opening, opposite sides, and a rear surface, said gimbal housing further including a first generally vertical side member extending rearwardly from one side of said end plate, and a second generally vertical side member extending rearwardly from the other side of said end plate, wherein said marine propulsion device further comprises a source of hydraulic fluid located inside the boat and communicating with said first portions of said pair of hydraulic lines, a manifold fixedly attached to said rear surface of said end plate adjacent said opening in said end plate and communicating with said first and second portions of said pair of hydraulic lines, said second portions of said pair of hydraulic lines extending downwardly from said manifold and inwardly of said sides of said gimbal housing along said rear surface of said end plate, and rearwardly to said cylinder.

14. A marine propulsion device as set forth in claim 13 wherein each of said second portions of said hydraulic lines includes a rigid sub-portion communicating with said manifold and extending downwardly along said rear surface of said end plate, and a flexible sub-portion communicating between rigid sub-portion and said cylinder.

15. A marine propulsion device as set forth in claim 14 wherein each of said hydraulic lines includes a protective jacket covering said flexible sub-portion.

16. A marine propulsion device comprising a gimbal housing adapted to be fixedly attached to the transom of a boat and including an end plate adapted to be generally aligned with the boat transom and having an upper end, an opening adjacent said upper end, opposite sides, and a rear surface, said gimbal housing also including a first generally vertical side member extending rearwardly from one side of said end plate, and a second generally vertical side member extending rearwardly from the other side of said end plate, a gimbal ring pivotally connected to said gimbal housing for pivotal movement relative to said gimbal housing about a generally vertical steering axis, said gimbal ring having a lower end and opposite sides, a propulsion unit pivotally connected to said gimbal ring for pivotal movement relative to said gimbal ring about a generally horizontal tilt axis located below said opening, and for pivotal movement with said gimbal ring about said steering axis, a first hydraulic cylinder/piston assembly pivotally connected to one side of said lower end of said gimbal ring and to said propulsion unit about respective axes respectively fixed relative to said gimbal ring and said propulsion unit for effecting pivotal movement of said propulsion unit relative to said gimbal ring, said first assembly including a first cylinder having an upper portion, a forward end connected to said gimbal ring, and a rearward end, a first piston slidably received in said first cylinder and dividing said first cylinder into forward and rearward pressure chambers, a first piston rod having an inner end fixedly attached to said first piston, and an outer end extending outwardly of said rearward end of said first cylinder and being connected to said propulsion unit, and a first cover member over said upper portion of said first cylinder, a second hydraulic cylinder/piston assembly pivotally connected to the other side of said lower end of said gimbal ring and to said propulsion unit about respective axes respectively fixed relative to said gimbal ring and said propulsion unit for effecting pivotal movement of said propulsion unit relative to said gimbal ring, said second assembly including a second cylinder having an upper portion, a forward end connected to said gimbal ring, and a rearward end, a second piston slidably received in said second cylinder and dividing said second cylinder into forward and rearward pressure chambers, a second piston rod having an inner end fixedly attached to said second piston, and an outer end extending outwardly of said rearward end of said second piston and being connected to said propulsion unit, and a second cover member over said upper portion of said second cylinder, a manifold fixedly attached to said rear surface of said end plate adjacent said opening in said end plate, conduit means extending through said opening in said end plate and having one end adapted to communicate with a source of hydraulic fluid inside the boat, and an opposite end communicating with said manifold, a first pair of hydraulic lines communicating between said first cylinder and said manifold and extending downwardly from said manifold and inwardly of said first side of said gimbal housing along said rear surface of said end plate in forward relation to said tilt axis and in rearward relation to the transom, and then rearwardly to said forward end of said first cylinder, one of said hydraulic lines of said first pair being connected to said forward pressure chamber of said first cylinder, and the other of said hydraulic lines of said first pair extending along said first cylinder inside said first cover member and being connected to said rearward pressure chamber of said first cylinder, each of said hydraulic lines of said first pair including a first rigid portion communicating with said manifold, a first flexible portion communicating between said first rigid portion and said first cylinder, and a protective jacket covering said first flexible portion, and a second pair of hydraulic lines communicating between said second cylinder and said manifold and extending downwardly from said manifold and inwardly of said second side of said gimbal housing along said rear surface of said end plate in forward relation to said tilt axis and in rearward relation to the transom, and then rearwardly to said forward end of said second cylinder, one of said hydraulic lines of said second pair being connected to said forward pressure chamber of said second cylinder, and the other of said hydraulic lines of said second pair extending along said second cylinder inside said second cover member and being connected to said rearward pressure chamber of said second cylinder, each of said hydraulic lines of said second pair including a second rigid portion communicating with said manifold, a second flexible portion communicating between said second rigid portion and said second cylinder, and a protective jacket covering said second flexible portion.

17. A marine propulsion device comprising a gimbal housing adapted to be fixedly attached to the transom of a boat and including therein an opening, a gimbal ring pivotally connected to said gimbal housing for pivotal movement relative to said gimbal housing about a generally vertical steering axis, a propulsion unit pivotally connected to said gimbal ring for pivotal movement relative to said gimbal ring about a generally horizontal tilt axis located below said opening, and for pivotal movement with said gimbal ring about said steering axis, a hydraulic cylinder/piston assembly pivotally connected to said gimbal ring and said propulsion unit about respective axes respectively fixed relative to said gimbal ring and said propulsion unit for affecting pivotal movement of said propulsion unit relative to said gimbal ring, and conduit means extending through said opening and downwardly from said opening in forward relation to said tilt axis and in rearward relation to the transom and having one end adapted to communicate with a source of hydraulic fluid inside the boat, and an opposite end communicating with said hydraulic cylinder/piston assembly.

* * * * *